United States Patent [19]

Forsse et al.

[11] Patent Number: 4,665,640

[45] Date of Patent: May 19, 1987

[54] ELECTROMECHANICAL CONTROLLER

[75] Inventors: Earl K. Forsse, Granada Hills; Larry K. Larsen, Canoga Park; John M. Davies, Atascadero, all of Calif.

[73] Assignee: Gray Ventures, Inc., Fremont, Calif.

[21] Appl. No.: 712,844

[22] Filed: Mar. 18, 1985

[51] Int. Cl.[4] ..... G09F 13/00

[52] U.S. Cl. ..... 40/457; 446/301; 40/463

[58] Field of Search ..... 40/457; 46/232, 171

[56] References Cited

U.S. PATENT DOCUMENTS 3,204,358 9/1965 Jones ..... 40/457
4,207,704 6/1980 Akiyama ..... 40/457

FOREIGN PATENT DOCUMENTS 717257 9/1965 Canada ..... 40/457
2335901 12/1975 France ..... 40/457

*Primary Examiner*—Gene Mancene
*Assistant Examiner*—Wenceslao J. Contreras
*Attorney, Agent, or Firm*—Blakely, Sokoloff, Taylor & Zafman

[57] ABSTRACT

A controller including a servo to time movement of an animated character with audible sounds reproduced in synchronism with control signals for the servo. A slippable friction drive also makes it permissible to interrupt movement of the character for any period of time. After such an interruption is terminated, the servo and friction drive return the movement of the character to a normal phase and amplitude.

17 Claims, 9 Drawing Figures

FIG. 7
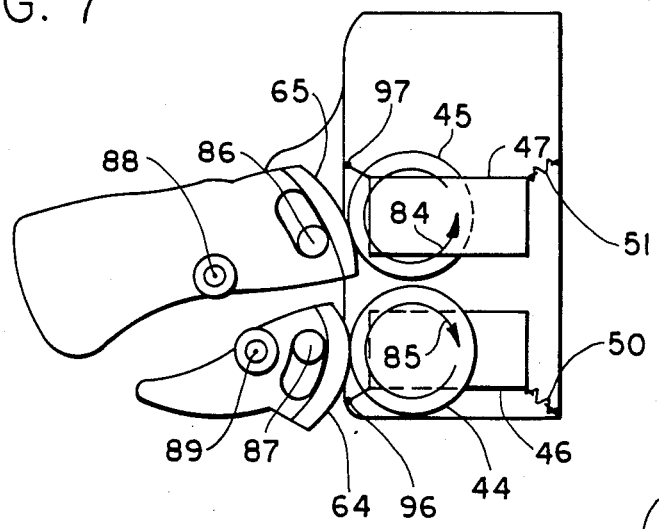
FIG. 8
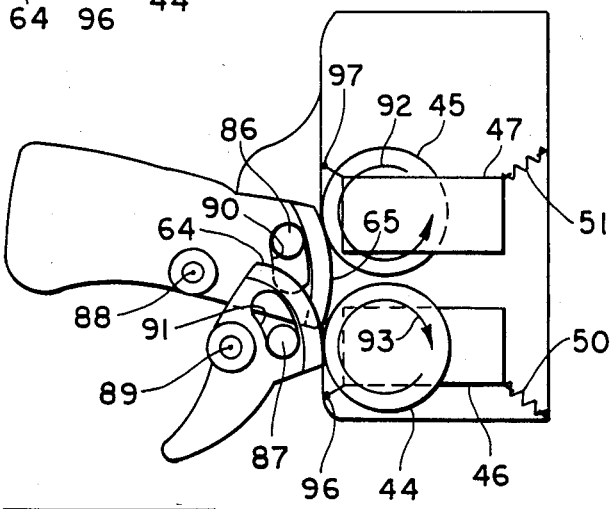
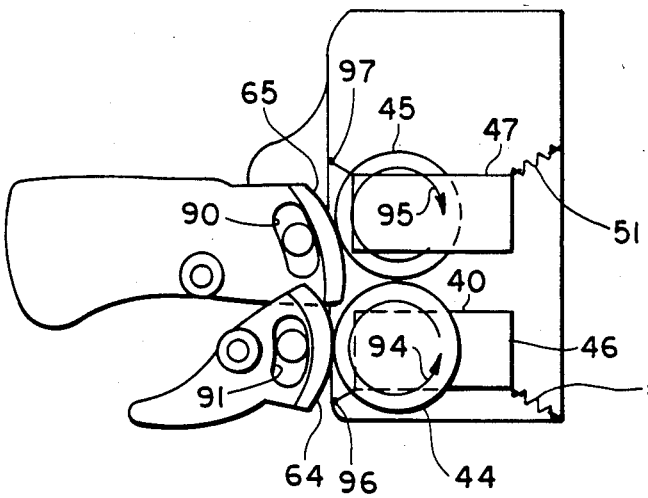
FIG. 9

ELECTROMECHANICAL CONTROLLER

BACKGROUND OF THE INVENTION

This invention relates to apparatus for timing the motion of an animated character, and more particularly to means for accurately causing the character to move in timed relation with a sound track or the like.

PRIOR ART STATEMENT

It is known in the prior art that control signals and audible sounds may be reproduced together from side-by-side recordings thereof for causing a character to be animated in time with the sounds. Such an arrangement is disclosed in Rogers U.S. Pat. No. 3,131,497 issued May 5, 1964.

The foregoing prior art arrangement does not accurately control the character movements. Moreover, interruption of such movements can cause cumulative dislocation of sound and motion.

SUMMARY OF THE INVENTION

The above-described and other disadvantages of the prior art are overcome by providing a servomechanism to control the movement of an animated character synchronously with sounds recorded contemporaneously with control signals for the servo.

The audio-visual effect of the synchronously controlled animation is thereby much improved over effects produced by prior art apparatus.

Further, interrupted motion is permitted by a slippable friction drive. The same is also employed with the servo to return animation to servo control.

BRIEF DESCRIPTION OF THE DRAWINGS

In the drawings, which are to be regarded as merely illustrative:

FIGS. 7, 8 and 9 are diagrammatic views illustrating motion of the animated toy figure.

DESCRIPTION OF THE PREFERRED EMBODIMENTS

Figure 1:
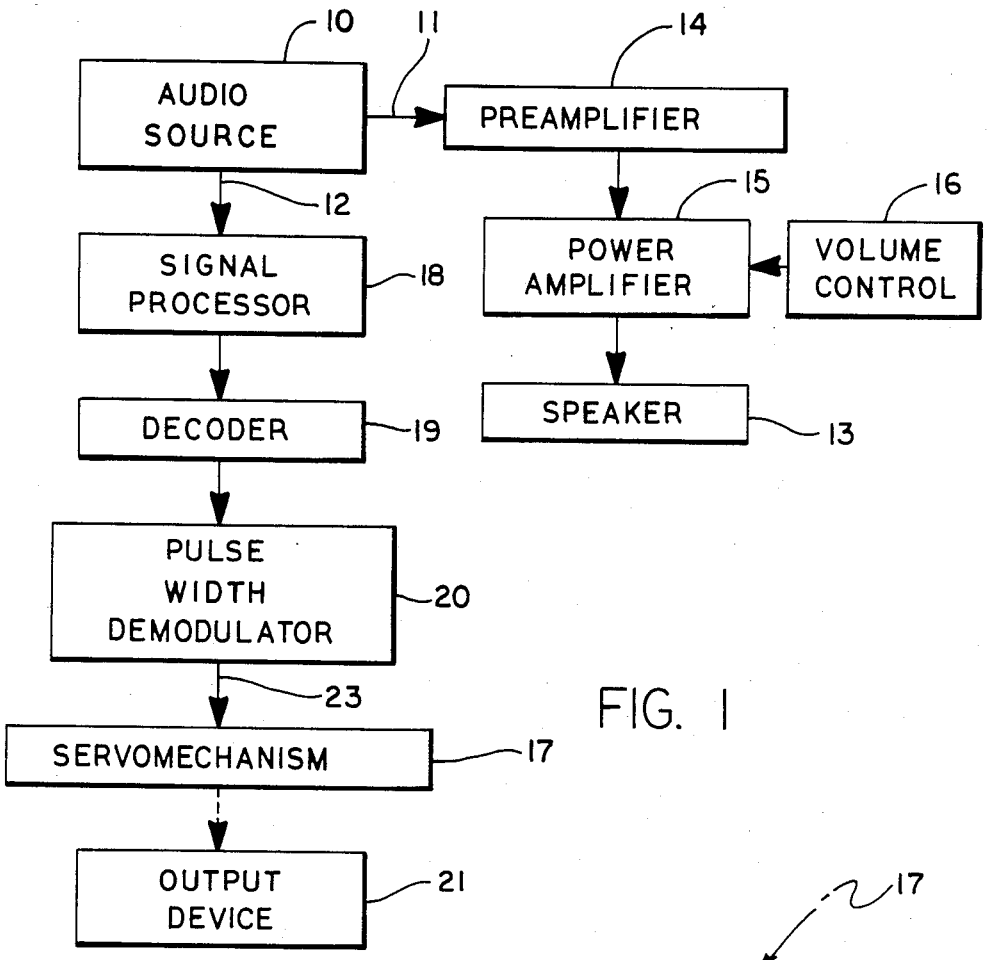
FIG. 1 is a block diagram of a controller constructed in accordance with the present invention.

In the drawings, in FIG. 1, a conventional audio source 10 is provided for producing audio signals in an audio channel 11, and conventional pulse width modulated control signals in a control channel 12.

Audio signals are impressed upon a conventional speaker 13 via a conventional preamplifier 14 and a conventional power amplifier 15. A conventional volume control 16 is connected to power amplifier 15.

The control signals are impressed upon the input of a servomechanism 17 through a conventional signal processor 18, a conventional decoder 19, and a conventional pulse width demodulator 20.

Servomechanism 17 moves an output device 21 through a slippable friction drive to be described.

Figure 2:
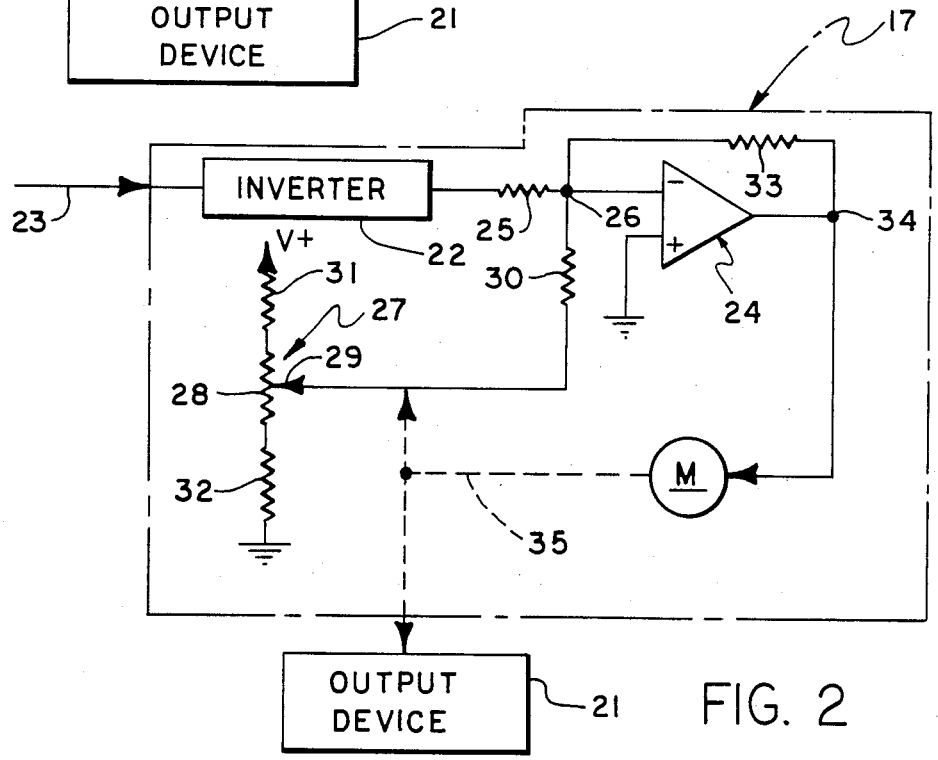
FIG. 2 is a schematic diagram of a servomechanism employed with the invention.

Servomechanism 17 is shown in more detail in FIG. 2 including an inverter 22 connected from an input lead 23 to the inverting input of a differential amplifier 24 via a resistor 25 and a junction 26. Inverter 22 may be omitted if the input lead 23 always carries a negative potential.

A potentiometer 27 is provided having a winding 28 and a wiper 29 connected to junction 26 via a resistor 30. The noninverting input of amplifier 24 is grounded. A resistor 31 is connected from one end of winding 28 to a positive potential V.

A resistor 32 is connected from the other end of winding 28 to ground.

A feedback resistor 33 is connected from an output junction 34 to junction 26. The output of amplifier 24 is connected to a servomotor M via junction 34. Servomotor M drives pot wiper 29 and output device 21.

Servomechanism 17 may be of the type employed to control mechanical movement, but the same has not been employed in the prior art to control the movement of an animated character synchronously with the reproduction of audible sounds. For example, a toy figure may thus be moved appropriately so that it appears to speak or to sing.

In some cases feedback resistor 33 may be omitted. In any case, amplifier 24 drives servomotor M until junction 26 is at a virtual ground. Servomotor M has an output shaft 35. The angular position of shaft 35 is then a function of or directly proportional to the amplitude of the negative potential appearing at the output of inverter 22.

Note, in accordance with an outstanding feature of the present invention, that servomechanism 17 employs aplifier 24 of a positive gain such that servomotor shaft 35 is rapidly driven to follow the potential on input lead 23 with a minimum or no overshoot. The control signals are manually recorded with the recording or reproduction of the sound in a conventional manner. Thus, if the control signals are properly and almost synchronously recorded with the sound, the motion is properly and synchronously produced with the sound because of the rapid response of the servomechanism 17.

Figures 3, 4:
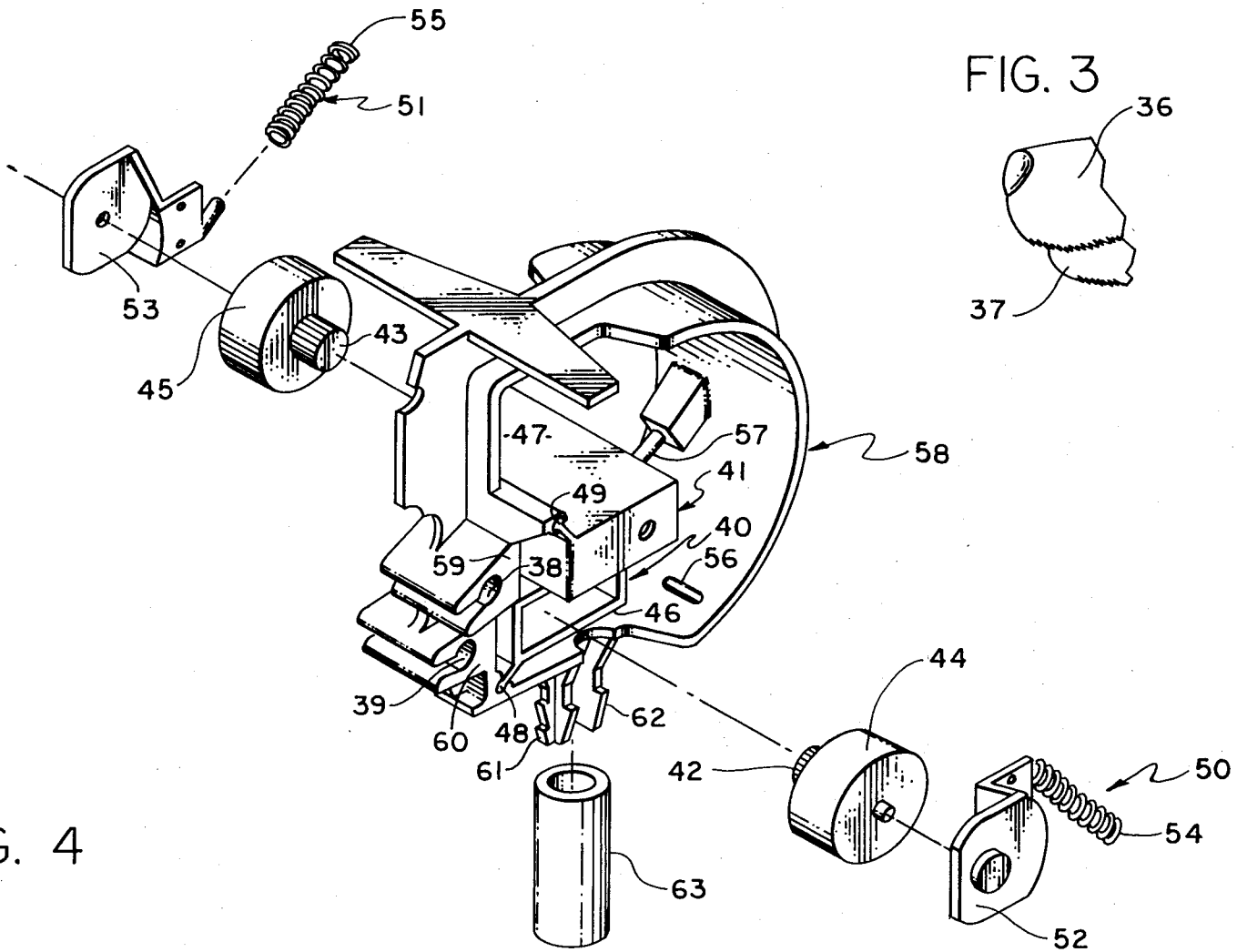
FIG. 3 is a perspective view of the mouth of a toy figure to be animated.
FIG. 4 is an exploded perspective view of two servo motors and mountings therefor.

The nose 36 and lower jaw 37 of a toy figure are shown in FIG. 3. In accordance with the present invention, the toy figure may be made to appear to talk or to sing by moving the nose 36 and the jaw 37.

The axes of bores 38 and 39 are not pivot axes. The bores 38 and 39 are slots to facilitate assembly by sliding the nose and mouth assemblies into them. The actual pivot axes are inside the nose and mouth as shown at 88 and 89 in FIGS. 1 and 8.

Part 65 is a part of the nose and rotates up and down on pivot A. Projection 66 slides into bore 38 and becomes a fixed extension of the head frame, projection 66 passing through the slot in part 65 and providing the up and down "stops" for the nose.

Servomotors 40 and 41 are shown in FIG. 4 to drive gears 42 and 43, respectively. Gears 42 and 43 are respectively connected to friction drive rollers 44 and 45.

Servomotors 40 and 41 have housings 46 and 47 which are hinged at 48 and 49. Housings 4 and 47 are spring biased by helically coiled tension springs 50 and 51 fixed to brackets 52 and 53 that are, in turn, fixed to respective housings 46 and 47. Ends 54 and 55 of springs 50 and 51 are fixed to appendages 56 and 57 of a supporting frame 58 to which housings 46 and 47 are hinged at 48 and 49.

As shown, bores 38 and 39 are provided in appendages 59 and 60 of frame 58.

Frame 58 has extensions 61 and 62 which can themselves be supported in a ferrule 63.

Figure 5:
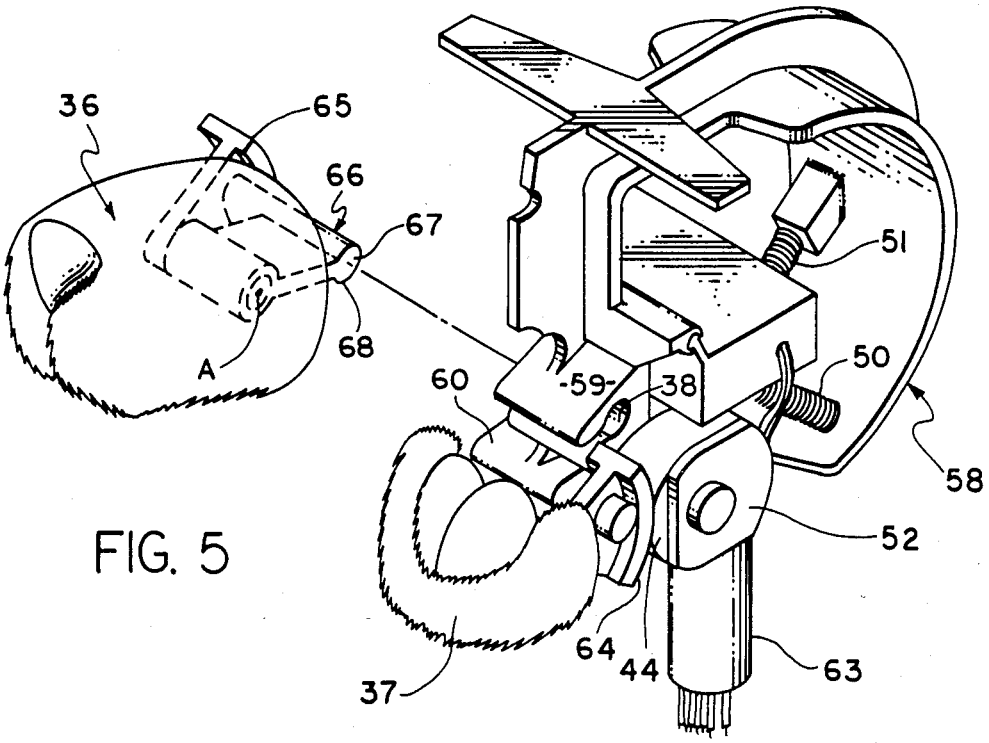
FIG. 5 is an exploded perspective view with some of the structures of FIG. 4 assembled.

In FIG. 5, an arcuately shaped member 64 is shown which is oscillated about axis by frictional engagement of drive roller 44 therewith. Member 64 is fixed relative to jaw 37 and therefore oscillates jaw 37 therewith.

Similarly, an arcuately shaped member 65 fixed to nose 36 is driven by frictional engagement of drive roller 45 therewith. Nose 36 has a projection 66 fixed relative thereto which has an enlargement 67 on a stem 68.

Figure 6:
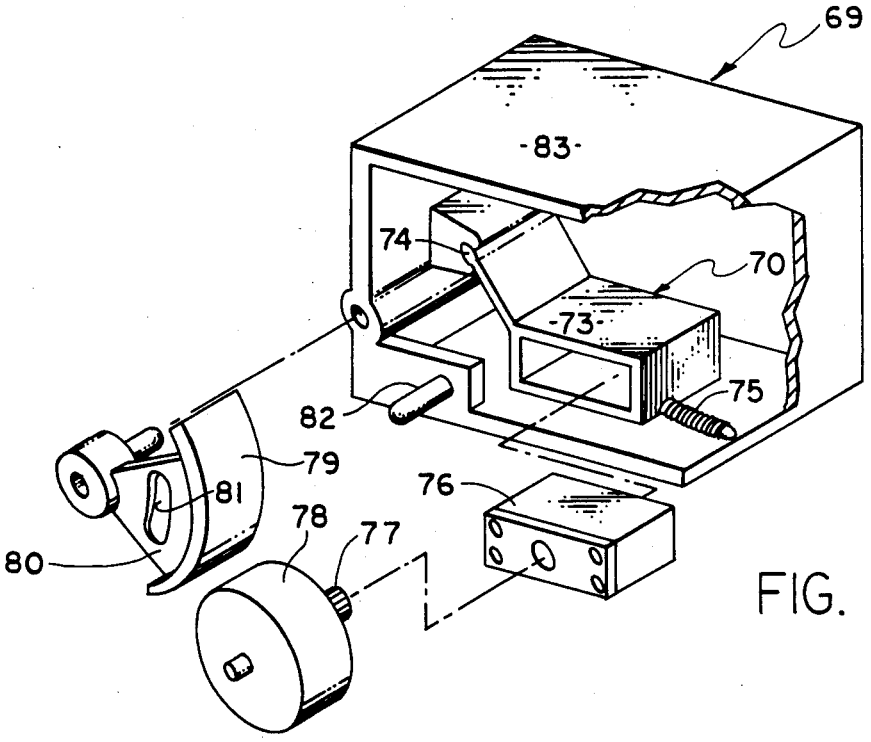
FIG. 6 is an exploded perspective view of another embodiment of the present invention.

In FIG. 6, an assembly 69 including a servomotor 70 is shown for causing some movement.

Servomotor 70 has a housing 73, as before, a hinge axis 74 and a tension spring 75.

Housing 73 has a cover 76 through which a gear 77 fixed to a drive roller 78 is driven. Roller 78 frictionally engages another arcuately shaped member 79. Member 79 has a web 80 with an arcuate slot 81 therethrough. A fixed stop 82 extends through slot 81.

Except for fixed structure 83, the structure for moving nose 36 and jaw 37 may be the same as that shown in FIG. 6.

Although overtravel is not necessary, drive rollers 44 and 45 may overtravel slightly in directions opposite those of arrows 84 and 85. After that, movement in directions 84 and 85 will take place. Note also stops 86 and 87 and axes of rotation 88 and 89 in FIG. 7.

When stops 86 and 87 are positioned in slots 90 and 91 as shown in FIG. 8, drive rollers 44 and 45 eventually reverse and move in directions as shown at 92 and 93.

When slots 90 and 91 are positioned around stops 86 and 87 shown in FIG. 9, drive rollers 44 and 45 will be rotated in directions 94 and 95 or in directions opposite thereto depending upon whether the nose 36 and jaw 37 are moving toward each other or away from each other.

Note will be taken that the force supplied by spring 51 determines the pressure of drive roller 45 on member 65. Similarly, the force supplied by spring 50 determines the pressure of drive roller 44 on member 64. Housing 46 is pivoted at 96. Housing 47 is pivoted at 97.

From the foregoing it will be appreciated that servomotors 40 and 41, being of the type shown at M in FIG. 2, operate with a servomechanism of the type 17 shown in FIG. 2 to provide a large dynamic response to input signals on input leads thereto. Continuous, fast and accurate motion control is thus provided as opposed to the limited control provided in the prior art.

Another outstanding advantage of the invention is that nose 36 and jaw 37 may be manually held together with one hand for an indeterminate period of time. In such a case, drive rollers 44 and 45 will slip on members 64 and 65. After the nose 36 and jaw 37 are released, the stops 86 and 87 will cause the movements of nose 36 and jaw 37 to return to their normal phases and amplitudes and in a manner to be in time with or synchronous with the talking, singing or other sounds reproduced by speaker 13. That is, there is a recovery mechanism after motion has been interrupted.

In accordance with the present invention, the radio broadcast of signals for sound and control signal reproduction may be made.

The recording of pulse width modulated control signals may be made manually in real time.

The present invention may be employed to move a mouth, eyes, arms, legs or all movable parts of a character to be animated, or any one or more of such parts alone or in any combination. Moreover, the invention may be employed to move a part of an animated sign or the like not necessarily resembling a living creature.

What is claimed is:

1. A controller for an animated character, said controller comprising:

an audio source having an audio channel and a separate control channel;

a speaker for reproducing sound from signals played back through said audio channel;

said audio source including means with audio signals and modulated control signals recorded thereon, respectively;

said audio source playing said audio signals back through said audio channel while synchronously playing said modulated control signals back through said control channel;

a character to be animated having a part adapted for movement;

said modulated control signals being modulated according to the desired mechanical movement of said part, a demodulator coupled to said control channel for demodulating said modulated control signals to produce a demodulated output signal proportional to said desired movement; and a servomechanism connected from said demodulator for proportionally moving said part in accordance with said demodulated output signal.

2. The invention as defined in claim 1, wherein:

said servomechanism includes a differential amplifier having inverting and non-inverting inputs and an output, a potentiometer having a winding and a wiper, a source of a regulated voltage;

a first resistor connected from said source to one end of said potentiometer winding, a second resistor connected from the other end of said potentiometer winding to ground;

a third resistor connected from said demodulator to said inverting input;

a fourth resistor connected from said wiper to said inverting input;

a servomotor connected from said amplifier output to move said part and said potentiometer wiper in synchronism; and a feedback resistor connected from said inverting input to said amplifier output, said noninverting input being grounded.

3. The invention as defined in claim 2, wherein:

said servomechanism includes stop means to limit movement of said part in at least one direction, and a slippable friction drive connected between said servomotor and said part, whereby said servomotor and said part may move independently when movement in unison is inhibited.

4. The invention as defined in claim 1, wherein:

said servo mechanism includes a servomotor having an output shaft, a feedback potentiometer, and means responsive to the outputs of said feedback potentiometer and said demodulator for driving said feedback potentiometer and said character part via said servomotor shaft until the displacement of said servomotor output shaft is in accordance with the magnitude of the output signal of said demodulator.

5. The invention as defined in claim 4, wherein:

said servomechanism includes stop means to limit movement of said part in at least one direction, and a slippable friction drive connected between said servomotor and said part.

6. The invention as defined in claim 1, wherein:

said servomechanism includes a servomotor having an output shaft to move said part, and a feedback circuit for causing said servomotor output shaft to move in synchronism with said demodulator output signal.

7. The invention as defined in claim 6, wherein:

said servomechanism includes stop means to limit movement of said part in at least one direction, and a slippable friction drive connected between said servo motor and said part, whereby said servomotor and said part may move independently when movement in unison is inhibited.

8. The invention as defined in claim 4, wherein:

a first shaft is provided, said part being rotatable on said first shaft, said part having a pivoted arcuate portion of a cylinder fixed thereto, said servomotor having an output shaft;

a drive wheel fixed to said servomotor output shaft, a spring to bias said drive wheel into engagement with said arcuate portion, said arcuate portion having an arcuate slot, and a stop pin in said slot.

9. A self-aligning drive mechanism for an animated character, comprising:

a part for oscillatory movement;

a reversible motor having an output shaft;

a pivoted driven member in the shape of an arcuate portion of a cylinder fixed to said part, said driven member having a web with a slot therethrough, a stop pin over which said slot is slidable;

a drive wheel fixed to said motor output shaft; and a spring to bias said drive wheel against said driven member, said drive wheel being slippable on but capable of frictionally driving said driven member, whereby when said part is first manually held stationary and said driven member slips against said arcuate portion, and said part is thereafter manually released, said stop pin causes said driven member to slip on said arcuate portion until movement of said part returns to the phase and amplitude of its normal movement when the same is not manually disturbed.

10. A self-aligning drive mechanism for an animated character, comprising:

a character having a part for movement;

means including a motor to supply mechanical motor movement according to a predetermined program;

said motor having a drive shaft;

a friction drive between said drive shaft and said part;

said friction drive being slippable when said part is overloaded; and stop means for said part to limit overtravel thereof, whereby movement of said part between predetermined mechanical limits and according to said program will be automatically resumed after the same has been manually interrupted.

11. The invention as defined in claim 10, wherein:

said friction drive includes a friction wheel fixed to said drive shaft;

a driven member in the shape of an arcuate portion of a cylinder fixed to said part; and means to bias said friction wheel against said arcuate portion.

12. The invention as defined in claim 17, wherein:

said driven member has a web with a slot therethrough;

said stop means including a stop pin over which said slot is slidable.

13. The invention as defined in claim 12, wherein:

means are provided to energize said motor in a manner to oscillate said driven member with said pin alternately reaching the ends of said slot.

14. A controller for an animated character, said controller comprising:

an audio source having an audio channel and a separate control channel;

a speaker for reproducing sound from signals played back through said audio channel;

said audio source including means with audio signals and modulated control signals recorded thereon, respectively;

said audio source playing said audio signals back through said audio channel while synchronously playing said modulated control signals back through said control channel;

a character to be animated having a part adapted for movement;

said modulated control signals being modulated according to the desired mechanical movement of said part, a demodulator coupled to said control channel for demodulating said modulated control signals to produce a demodulated output signal proportional to said desired movement; and a servomechanism connected from said demodulator for proportionally moving said part in accordance with said demodulated output signal, said servomechanism including a servomotor having an output shaft, a feedback potentiometer, and means responsive to the outputs of said feedback potentiometer and said demodulator for driving said feedback potentiometer and said character part via said seromotor shaft until the displacement of said servomotor output shaft is in accordance with the magnitude of the output signal of said demodulator, said servomechanism further including stop means to limit movement of said part in at least one direction, and a slippable friction drive connected between said servomotor and said part, said slippable friction drive having approximately the same friction irrespective of the direction of slippage.

15. A controller for an animated character, said controller comprising:

an audio source having an audio channel and a separate control channel;

a speaker for reproducing sound from signals played back through said audio channel;

said audio source including means with audio signals and modulated control signals recorded thereon, respectively;

said audio source playing said audio signals back through said audio channel while synchronously playing said modulated control signals back through said control channel;

a character to be animated having a part adapted for movement;

said modulated control signals being modulated according to the desired mechanical movement of said part, a demodulator coupled to said control channel for demodulating said modulated control signals to produce a demodulated output signal proportional to said desired movement; and a servomechanism connected from said demodulator for proportionally moving said part in accordance with said demodulated output signal, said servomechanism including a servomotor having an output shaft to move said part, and a feedback circuit for causing said servomotor output shaft to move in synchronism with said demodulator output signal;

said servomechanism further including stop means to limit movement of said part in at least one direction; and a slippable friction drive connected between between said servomotor and said part, said slippable friction drive having approximately the same friction irrespective of the direction of the slippage, whereby said servomotor and said part may move independently when movement in unison is inhibited.

16. A controller for an animated character, said controller comprising:

an audio source having an audio channel and a separate control channel;

a speaker for reproducing sound from signals played back through said audio channel;

said audio source including means with audio signals and modulated control signals recorded thereon, respectively;

said audio source playing said audio signals back through said audio channel while synchronously playing said modulated control signals back through said control channel;

a first shaft to be animated having a part adapted for rotational movement on said first shaft, said part having a pivoted arcuate portion of a cylinder fixed thereto;

said modulated control signals being modulated according to the desired mechanical movement of said part, a demodulator coupled to said control channel for demodulating said modulated control signals to produce a demodulated output signal proportional to said desired movement; and a servomechanism connected from said demodulator for proportionally moving said part in accordance with said demodulated output signal, said servomechanism including a servomotor having an output shaft, a feedback potentiometer, and means responsive to the outputs of said feedback potentiometer and said demodulator for driving said feedback potentiometer and said character part via said servomotor shaft until the displacement of said servomotor output shaft is in accordance with the magnitude of the output signal of said demodulator, said servomotor having an output shaft, a drive wheel fixed to said servomotor output shaft, a spring to bias said drive wheel into engagement with said arcuate portion, said arcuate portion having an arcuate slot, and a stop pin in said slot;

said servomotor being supported from said character on a pivot located substantially on a line tangent to said arcuate portion of said part at the point of contact of said drive wheel therewith, whereby drive forces between said drive wheel and said part do not cause substantial change in the bias of said drive wheel against said arcuate portion.

17. A self-aligning drive mechanism for an animated character, comprising:

a character having a part for movement;

means including a motor to supply mechanical motor movement according to a predetermined program;

said motor having a drive shaft;

a friction drive between said drive shaft and said part;

said friction drive including a friction wheel fixed to said drive shaft;

a driven member in the shape of an arcuate portion of a cylinder fixed to said part;

means to bias said friction wheel against said arcuate portion;

said friction drive being slippable when said part is overloaded;

stop means for said part to limit overtravel thereof, whereby movement of said part between predetermined mechanical limits and according to said program will be automatically resumed after the same has been manually interrupted; and said motor being supported from said character on a pivot located substantially on a line tangent to said arcuate portion of said part at the point of contact of said drive wheel therewith, whereby drive forces between said drive wheel and said part do not cause substantial change in the bias of said drive wheel against said arcuate portion.

* * * * *